US006056481A

United States Patent [19]

Watermann et al.

[11] Patent Number: 6,056,481

[45] Date of Patent: May 2, 2000

[54] METHOD AND DEVICE FOR MONITORING THE LOAD ON HYDRAULIC POWERED SHIELD SUPPORTS FOR UNDERGROUND MINING

[75] Inventors: Willy Watermann, Dortmund; Walter von der Linden, Erkrath; Wilfried Weigel, Werne, all of Germany

[73] Assignee: DBT Automation GmbH, Essen, Germany

[21] Appl. No.: 08/923,568

[22] Filed: Sep. 4, 1997

[30] Foreign Application Priority Data

Sep. 7, 1996 [DE] Germany ..... 196 36 389

[51] Int. Cl.[7] ..... E12D 15/44

[52] U.S. Cl. ..... 405/294; 405/288

[58] Field of Search ..... 405/302, 288, 405/291, 292, 290, 293, 294, 295, 296; 299/11, 12

[56] References Cited

U.S. PATENT DOCUMENTS 4,474,510 10/1984 Bull ..... 405/302
4,693,640 9/1987 Berger ..... 405/294
4,755,084 7/1988 Peters et al. ..... 405/302
4,887,935 12/1989 Koppers et al. ..... 405/302
5,523,638 6/1996 Merriman ..... 405/302

*Primary Examiner*—Eileen Dunn Lillis
*Assistant Examiner*—Frederick Lagman
*Attorney, Agent, or Firm*—Bauer & Schaffer, LLP

[57] ABSTRACT

According to the invention, monitoring the load on hydraulic powered shield supports in underground use is performed by using the controller (13) serving for extraction control, which is equipped with microelectronics for load monitoring and load control, the components of the powered shield support being assigned sensors (14 to 18) whose electric measured values are used by the controller (13) for evaluating the measured signals and for driving the hydraulic rams (6, 7) and/or the angle cylinder (11) assigned to the powered shield support. The load control is preferably designed here in such a way that the critical load situations "one-sided loading" and/or "tip-toeing" are detected as early as during the setting operation, with the aid of appropriate sensors, and are rendered non-damaging in their effect by appropriately driving the hydraulic rams and/or the angle cylinder.

23 Claims, 2 Drawing Sheets

METHOD AND DEVICE FOR MONITORING THE LOAD ON HYDRAULIC POWERED SHIELD SUPPORTS FOR UNDERGROUND MINING

FIELD OF INVENTION

The invention relates to a method and a device for monitoring the load on hydraulic powered shield supports in underground mining.

BACKGROUND TO THE INVENTION

Powered shield supports have been used successfully for some time in underground extraction operations of bituminous coal. These are designed as so called lemniscate shields and are generally fitted with two or four hydraulic rams engaging under the canopy. However, these powered shield supports have to be of extraordinary stable design in terms of their components, in particular, their canopy, floor skid, guide bars and various hinges, so that they are able to cope with difficult conditions of use and unfavourable loading situations. This leads to a heavy and correspondingly expensive construction of the powered shield supports.

From the point of view of the mine operator, for reasons of application and economics, there is considerable interest in restricting the weight and hence also the costs of the shield construction. Depending on the existing infrastructure of the mines, and also on the seam strengths which are found, it is often possible only to use powered shield supports whose weight does not exceed about 15 t to 30 t. This limitation on the weight leads to high-strength and correspondingly expensive steel plates and steel cast parts having to be used for the highly-loaded components of the powered shield supports, which leads to considerable increases in costs in the production of the powered shield supports. In spite of the use of high-strength materials to restrict the weight, overloading of individual components occurs frequently during the underground use of the powered shield supports. Hence, high repair costs and a reduction in the service life of the powered shield supports.

In recent times, in order to reduce the investment and operating costs, powered shield supports have been used whose centre-to-centre spacing or overall width is 1.75 m instead of the previously usual dimension of 1.5 m. Further optimisation could be achieved using powered shield supports with even greater overall widths, but these would result in the abovementioned weight limitations being exceeded.

In modern support technology, the shield support, as is known, is equipped with electrohydraulic control systems, namely an electronic controller equipped with a microprocessor in each powered shield support. In this situation, the sensors are also used for detecting the respective ram pressures and the advancing cylinder strokes. These sensors being connected to the controller by their electric signal lines. Sensor technology is primarily used here for the automatic control of the movement sequences and tracking the powered shield support and the face conveyor and, if appropriate, also for monitoring the ram pressures.

Many attempts have been made in the past to construct the shield support more lightly and to design it such that its highly-loaded components are protected against overload and damage. DE 31 41 040 C1 proposed constructing the front guide bar or guide bars of the lemniscate mechanism as a hydraulic guide bar in the shape of a hydraulic cylinder. The intention being to keep the guide-bar forces constant or protected against overload during the use of the powered shield support. However, this solution path has not become widespread in practice, particularly because of the associated higher costs and the limitation in the force of the hydraulic guide bar due to the limitation in its cylinder diameter.

Further solution proposals for reducing the weight of the powered shield supports are indicated in the magazine "Glückauf" 1982, pp. 927 to 933. Here, too, the use of hydraulic guide bars for limiting the external forces parallel to the stratum is proposed. In addition, a reduction in weight is intended to be achieved in that, in the case of inclined upright rams, the ram pressures are controlled as a function of the ram angle, in order to keep the shield support force constant over the height adjustment range, or to cut off or to suppress peak values in terms of loading which result in the case of upright rams.

SUMMARY OF THE INVENTION

In accordance with the present invention, there is provided a method and a device for monitoring the load on hydraulic powered shield supports, with which, in particular, in the critical load situations, overstressing of the powered shield supports or of its components can be avoided reliably, without an excessive constructional outlay. Further, the powered shield supports can be constructed with a considerably reduced weight and therefore be more cost-effectively.

The abovementioned critical load situations during the use of the powered shield supports include, above all, their asymmetrical or one-sided loading in a setting state, such as, for example, in the case of roof cavities, roof settlements or other irregularities in the roof, and in which the ram-supported canopy is in contact with the roof only in the region of one of its two outer or side edges, whereas it is hollow on its other outer or side edge, that is to say makes no contact with the roof. A further critical load situation, which can lead to overload and is referred to in mining as "tip-toeing" arises when the powered shield support, as a result of the roof load on the canopy, which projects forward against the working face, is tilted in such a way that its floor skid lifts off from the floor at the rear, i.e. the waste end, and as a consequence the powered shield support rests on the floor with only that end of the floor skid which is at the working-face side. These critical load situations (which are indicated only by way of example), can lead to high stresses and to damage to the components of the shield support, cannot be reliably detected in continuous operation, particularly when the shield support at the face is equipped with an electro-hydraulic shield control system. It is therefore necessary to take account of the critical load situations, in that the powered shield supports must be designed very strongly in terms of construction, but which leads to increased shield weights and correspondingly high costs.

To achieve the abovementioned objective, the present invention provides a method, in which, with the aid of the electronic controller of the support control system and sensors assigned to the components of the power shield support, potentially critical load situations of the powered shield support are ascertained and are eliminated or suppressed by appropriate hydraulic pressure driving of the rams and/or of the angle cylinder or cylinders of the powered shield support by means of the controller.

In this situation, the electro-hydraulic control system of the shield support, together with the dedicated controller, having the electronic control system, in conjunction with the various sensors, is used in continuous operation for monitoring the loading of the powered shield support. The critical load situations are detected reliably and are able to be eliminated by means of appropriate control, in particular, the hydraulic rams or of their setting pressures, before overloading and damage to components in the shield support can occur. With the aid of the electro-hydraulic control system, which is present in any case in the shield support, and of additional sensors, it is accordingly possible for the shield support to be continuously monitored in use in relation to the critical load situations and, with the aid of appropriate algorithms, to be controlled via the electro-hydraulic control system in such a way that damaging stresses are detected immediately and eliminated via driving the powered shield supports. This makes it possible to reduce the high shield weights and the production costs associated with this, and also to dispense with the use of expensive high-strength steel grades. The reduction in weight of the powered shield supports also permits powered shield supports with larger width dimensions, preferably of 2 m, to be produced without predefined weight limits being exceeded. At the same time, the service life of the powered shield supports is considerably increased. Since, for monitoring the load on the powered shield supports, use is made of the electronic controllers which are in any case arranged on the latter for the shield control and which, in the method according to the invention, are equipped with microelectronics processing the measured signals from the sensors, the result provides considerable advantages in terms of construction and costs.

In accordance with the present method, the various monitoring sensors are designed and provided on the powered shield support or its components in such a way that, when in operational use, reliable detection of the critical load situations can be achieved. The components which are particularly highly loaded during the use of the powered shield supports are primarily the gob shield hinge, at which the gob shield is connected to the roof canopy, and the guide bars or their connecting hinges at the gob shield and at the floor member. These components are preferably assigned stress measuring sensors, which may comprise mechanical stress measuring devices, for example strain gauge arrangements, and which, during the use of the powered shield support, ascertain the mechanical stresses occurring on these components because of the loadings.

The respective stress measured values may be fed by electric signals to the electronic controller of the powered shield support for processing. The controller's electronics unit, comprising a microprocessor, compares the ascertained and fed actual values with predefined, maximum permissible limiting values and, if the limiting value is reached, supplies control signals which, for example, lead to a reduction in hydraulic setting pressures in the rams, thereby protecting the said components are protected against loading and damage. With the aid of pressure sensors which are assigned to the rams and which indicate the respective hydraulic ram pressures to the controller, continuous monitoring of the load on the said components and limiting of the load of the same can accordingly be achieved.

Furthermore, it is recommended to provide sensors for measuring the respective angular position of the front (working-face side) guide bars with respect to the gob shield. With the aid of these angle sensors, for which usual angle transmitters can be used, the electronic controller is fed the respective actual angle measured signals. The monitoring and control electronics of the controller is thus able to determine differences in the angular position of the two front guide bars, which are arranged with a parallel spacing from each other, which differences can be traced back to load asymmetry in the powered shield support, such as can occur, for example in the case of one-sided canopy loading of the powered shield support. It would be expedient for further sensors to be provided which detect the respective extension lengths of the hydraulic rams of the powered shield support, and feed them to the controller as actual values. Hence, in operational use, differences in the respective extended length of the left-side and right-side ram of the powered shield support can be detected by the monitoring and control electronics, these differences being characteristic of a potential critical load situation, in particular, the load situation of one-sided canopy loading. In all events, the measured values of the various sensors are fed as electric signals to the monitoring. Control electronics which are present in the powered shield support and are formed by a microprocessor, operate in accordance with predefined algorithms, for example an actual value/limiting value comparison, and execute electric control function in order to eliminate unfavourable load situations and impermissibly high stresses resulting therefrom in the components of the powered shield support. For example, the detection of different stresses in the gob shield hinge to the right and left of the same and/or of different angular positions between gob shield and the hinges to the right and left, given a simultaneous different pressure rise in the rams to the right and left and/or different extended lengths of the rams to the right and left would indicate the load situation of "one-sided loading". This load situation, detected by the monitoring and control electronics, gives rise to a control command which, for example, leads to the relieving of the load on the ram which has been extended to the greatest length and/or of the ram which has lagged in terms of the rise in pressure during the preceding setting operation, with the result that the one-sided loading on the powered shield support is cancelled, before the ram force rises from the original setting force to the higher adjusting force as a result of convergence of the struts.

With the aid of the sensor technology described above, it is possible to detect all the possible critical load situations in operational use, and to control the powered shield supports, using the electronic controllers, in such a way that overloading of the mechanical components of the powered shield supports is reliably avoided. This is also true for the load situation "lifting of the rear of the floor skid" (tip-toeing). In this load situation, via the electronic controller, the hydraulic angle cylinder or the pair of angle cylinders which are usually arranged on the powered shield support between the canopy and gob shield can be driven by the controller, by means of hydraulic pressure loading, in the retraction direction so that the powered shield support remains reliably on the floor, even with the rear of its floor skid.

Embodiments of the present invention will now be described, by way of example only, with reference to the accompanying figures; wherein

DETAILED DESCRIPTION OF THE EMBODIMENTS

Figure 2:
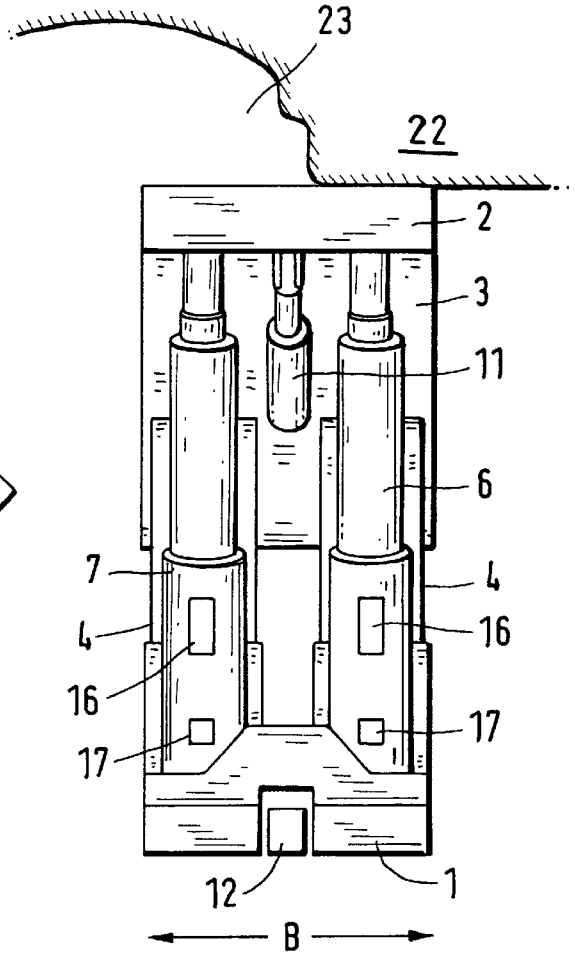
FIG. 2 shows the powered shield support of FIG. 1 in a view from the working face or coal face in the direction of the arrow II in FIG. 1.
Figure 1:
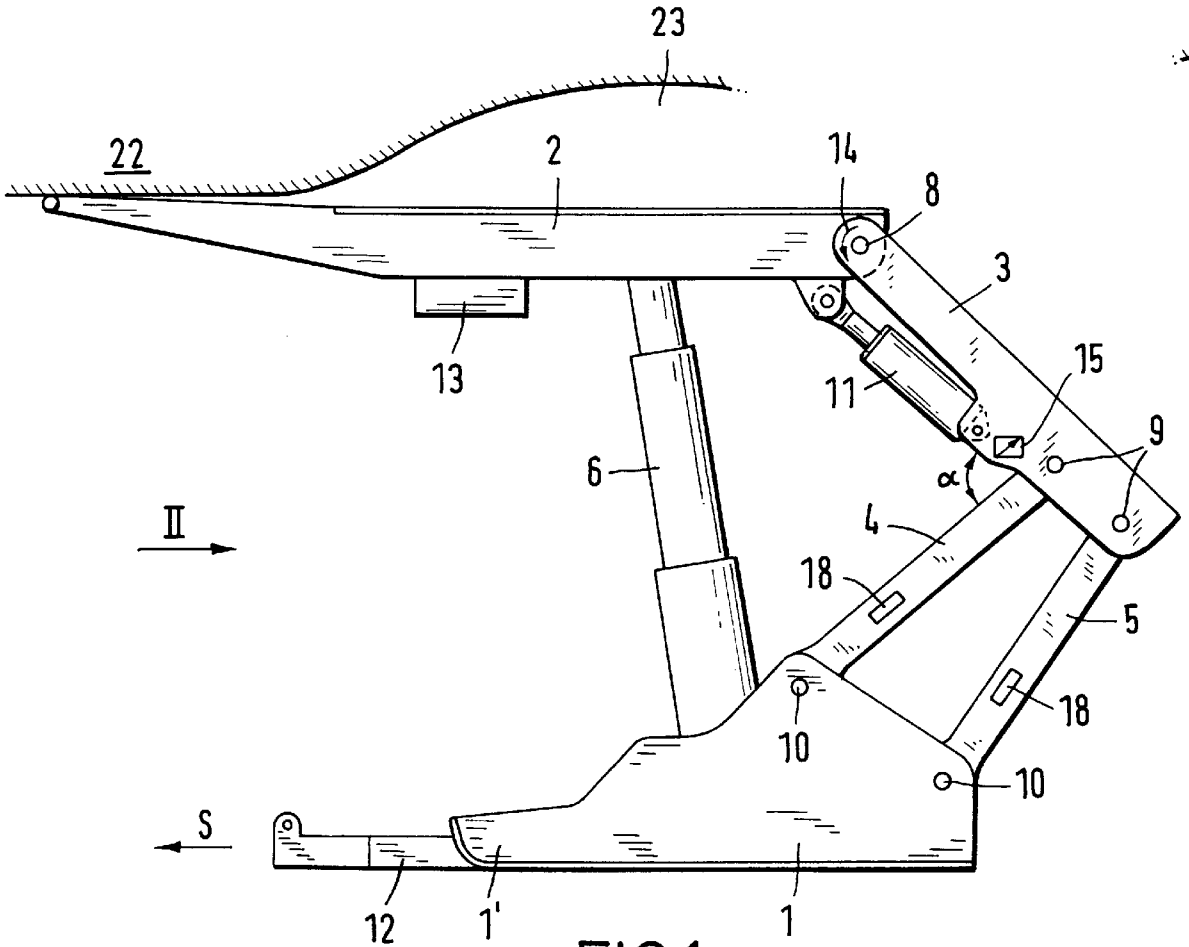
FIG. 1 shows in a schematic simplification and in a side view, a powered shield support known per se.

The powered shield support, which is shown in FIGS. 1 and 2 in a schematic simplification, for use in underground extraction operations, in particular in face operations for extracting coal, is, as known, designed as a lemniscate shield and comprises, in its main components, a floor skid 1, a canopy 2, which engages under the roof and projects forwards to the working or coal face, a gob shield 3 shielding the face area in relation to the waste area, guide bars 4 and 5 which, together with the gob shield 3, form a lemniscate linkage, and two hydraulic rams 6 and 7 which, as usual, are supported in bottom hinges on the floor skid and whose ram tops are connected to the canopy 2 in top hinges. The gob shield 3 is connected at the waste end of the canopy 2 in a gob shield hinge 8. The guide bars 4 and 5 are in each case connected to the gob shield 3 in connecting hinges 9, at a distance underneath the gob shield hinge 8. At their other ends, the guide bars 4 and 5 are connected in a hinged manner to the floor skid 1 or to a connecting bracket on the latter via connecting hinges 10, behind the rams 6 and 7. The hinges 8, 9 and 10 normally consist of strong bolt hinges. Arranged between the gob shield 3 and the canopy 2 is a hydraulic angle cylinder 11 which is connected in a hinged manner with its cylinder part to the gob shield 3 and with its piston-rod end to the canopy 2. The two hydraulic rams 6 and 7 are arranged parallel alongside each other. The powered shield support is accordingly implemented as a two-ram shield.

Instead of the latter, however, the powered shield support may also have more than two hydraulic rams, for example four rams, whose two pairs of rams 6, 7 are arranged at a distance one behind the other in the advance direction S of the powered shield support, between the floor skid 1 and the roof canopy 2, as is likewise generally known. The floor skid 1 may comprise a single-part floor member or else a two-part floor member, as is likewise known. The guide bars 4 and 5, which together with the gob shield 3 form the lemniscate mechanism, may comprise individual guide bars or else preferably pairs of guide bars, as can be seen from FIG. 2 for the two front (working-face side) guide bars 4. Instead of only a single angle cylinder 11, it is possible for an angle cylinder pair to be provided, as is known. 12 indicates a hydraulic advancing mechanism via which the powered shield support is coupled to a moveable face conveyor, not shown, so that it can advance in the extraction direction according to the arrow S.

All the abovementioned configuration features and configurative options are generally known in shield construction and therefore do not require any further explanation. In FIG. 2, B designates the overall width of the powered shield support, which is generally 1.5 m, but in the preferred exemplary embodiment is preferably at least 1.75 m and advantageously 2 m.

The control of the support shield which is performed by a series of powered support shields arranged close alongside one another, is performed, as is likewise known, with the aid of an electro-hydraulic shield control system, each powered support shield being assigned an electronic controller with whose aid the rams and all the further hydraulic working cylinders of the associate powered shield support are controlled by issuing commands in the sense of setting and withdrawing the rams and advancing the powered support shields. The dedicated controller is indicated at 13 in FIG. 1, here, by way of example, installed on the underside of the canopy 2.

The electronic controller 13, which actuates the electric solenoid valves assigned to the rams and the other working cylinders of the powered support shield, and for this purpose is implemented using microelectronics, is simultaneously used, according to the invention, for monitoring the load on the powered shield support in underground operational use. For this purpose, it has appropriate monitoring and control electronics.

In order to monitor the load, the powered shield support is provided with a series of sensors assigned to the individual components of the same. These are merely indicated in FIGS. 1 and 2, without their locational arrangement being determined by this. At least one sensor 14 is arranged on the gob shield hinge 8. It is advantageously arranged on the hinge bolt of the gob shield hinge 8. If the gob shield hinge 8 is assigned two hinge bolts which are arranged at a distance from each other on a common flight line in the transverse direction of the powered shield support, that is to say in the direction of its overall width B, the said hinge bolts producing the hinge connection between canopy 2 and gob shield 3, then each of these two individual hinges is advantageously assigned a sensor 14 in each case. Mechanical stress measuring devices are preferably used for the stress measuring sensor or sensors 14, and are arranged on the hinge bolt or the two hinge bolts forming the gob shield hinge, but can also be arranged on the hinge eyes, through which the hinge bolt or bolts passes or pass, in the canopy or the gob shield. With the aid of the stress measuring sensor or sensors 14, the loading or the mechanical stress on the gob shield hinge is measured during setting or in the set condition of the powered shield support.

Furthermore, the powered shield support has, for each of the two front guide bars 4 located on its right and left side, a sensor 15 in the shape of an angle transmitter, with the aid of which the angular position, indicated by the angle $\alpha$, of the guide bars 4 in relation to the gob shield 3 is picked off so that deviations in the angular position a between the two guide bars 4 may be established.

Each of the two hydraulic rams 6 and 7, which are arranged alongside each other in the transverse or width direction of the shield support, is assigned a sensor 16 which comprises a distance transducer determining the respective extension length of the relevant ram. Deviations in the extension length of the rams 6 and 7 can be established in this way. If the powered shield support has four rams located in a rectangular arrangement to one another, then a sensor 16 may be assigned to each individual ram or else to each ram pair, which is formed by two rams 6 and 7 standing laterally alongside each other. Sensors operating as distance transducers for determining the extension lengths of hydraulic cylinders are likewise known, for example in the design as ultrasonic measured value pick-ups.

Finally, the powered shield support, as is known, has pressure sensors 17 which measure the hydraulic setting pressures in the rams 6 and 7. Here, too, each of the two rams 6 and 7 that are arranged alongside each other is assigned a pressure sensor 17.

Finally, the front and rear guide bars 4 and 5 and/or their connecting hinges 9 or 10 are also provided with sensors 18 which detect the mechanical loadings of these guide bars in the setting condition of the powered shield support. These stress sensors 18 may also comprise mechanical stress measuring devices.

The electric measured value signals from all the abovementioned sensors 14 to 18 are fed via electric line connections to the support controller 13, which is equipped with monitoring and control electronics which acquire and process the measured values, and which may be formed by the microprocessor, which is present in any case, of the controller 13.

Figure 3:
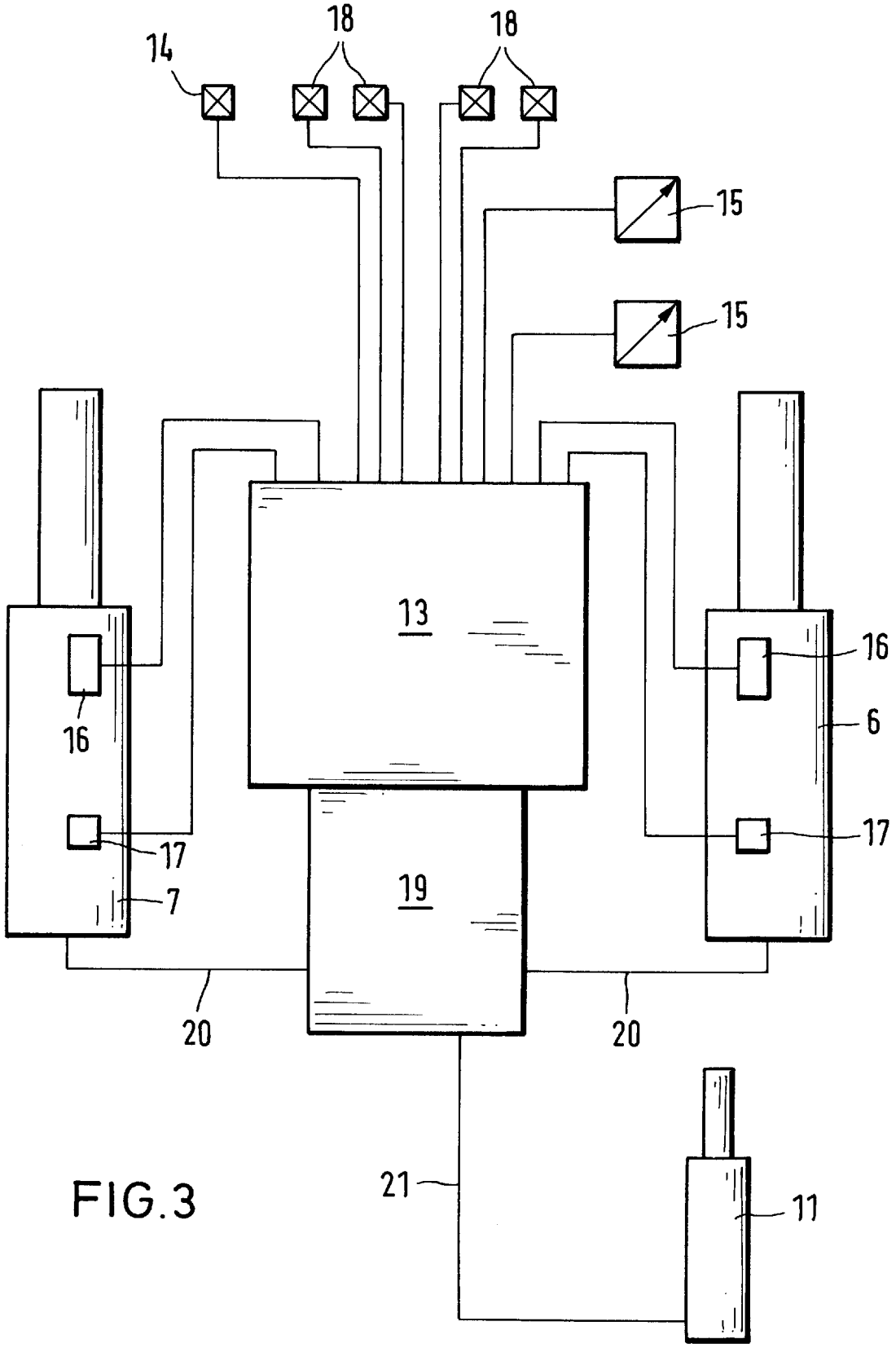
FIG. 3 shows, in a simple block diagram, a load monitoring system according to the invention for the powered shield support.

This arrangement is shown in a simplified circuit diagram in FIG. 3, with the electric signal lines from the various sensors 14 to 18 connected to the input of the controller 13. Also indicated here is a valve block 19 that is assigned to the electric controller 13 and in which the electrically switchable solenoid valves for the control of the individual working cylinders of the powered shield support are combined, the solenoid valves being driven and actuated via the electronic control system of the controller 13. Also indicated are the rams 6 and 7 and the angle cylinder 11, which are connected by their hydraulic pressure spaces, via hydraulic line connections 20 and 21, to the valve block 19, with the result that the pressures in the cylinder spaces of the rams 6 and 7 and, if appropriate, of the angle cylinder 11, can be influenced under control of the controller 13.

The load monitoring and control system described may operate, for example as follows:

If, during the setting of the powered shield support or in its set condition, a load situation arises in which overloading of the gob shield hinge 8 and/or of the guide bars 4, 5 can be established, the ram setting pressure in the rams 6 and 7 is reduced by the controller 13, which obtains the appropriate stress measured signals fed from the sensors 14 and/or the sensors 18, with the result that damage to these components as a result of overloading cannot occur. In this case, the stress measured values fed to the controller 13 from the relevant stress measuring sensors can be compared, by the electronics in the controller, as actual values with predefined limiting values corresponding to the highest loadings of the said components, so that when these limiting values are reached, an electric output signal is produced by the monitoring and control electronics of the controller 13 and, via the relevant solenoid valves in the magnetic block 19 and the hydraulic line connections 20, reduces or holds the hydraulic pressures in the pressure spaces of the rams 6 and 7 to or at a value which is not higher than the predefined limiting value.

A critical load situation arises in the case of asymmetrical loads on the powered shield support and, here, primarily in the case of one-sided canopy loading of the powered shield support. It is indicated in FIG. 2 that the roof 22 has, in the supporting region of the powered shield support, an irregularity, for example a cavity 23, so that when the powered shield support is being set, the canopy 2 cannot come into contact with the roof over its full width, but rather only over a partial width, here in the region of the right-hand side of the canopy, where the ram or rams 6 are located. The ram or rams 7 which is located on the other (left) side of the canopy supports the canopy 7 where it is exposed because of the cavity 23. Because of this asymmetry or the one-sided loading, forcible forces may be established during the setting of the powered shield support. In other words, during the extending of the rams 6 and 7, forces lead to overloading and damage of and to the mechanical components of the powered shield support, in particular the gob shield hinge 8 and/or the guide bars or their connecting hinges. With the aid of the sensors 14 and/or 18, which detect the mechanical stresses of the loaded components, it is possible for different stresses to result on the gob shield hinge 8, on its right and left side, and/or different angles $\alpha$ on the guide bar system between gob shield 3 and the guide bars 4, 5 located to right and left, given a simultaneous different pressure rise in the rams 6 and 7 located to right and left and/or different extension lengths of the rams 6 and 7 arranged to right and left, which can be traced back to the one-sided loading. These loading differences between the right-hand and left-hand components of the powered shield support are reported to the controller 13 via the various sensors mentioned and are evaluated in the controller, for example via the actual value/limiting value comparison mentioned, with the result that the controller or its monitoring and control electronics supplies at its output an electric control command which leads to the controlling of the hydraulic rams 6 and/or 7 in the sense of overload protection. This control command may bring about a relieving of the load on that ram or those rams which have been extended further during the setting operation than the other ram or rams. In the case of the arrangement shown in FIG. 2, this is the ram 7 standing under the exposed part of the canopy 2, which is thus relieved of its hydraulic setting load or limited in terms of its setting pressure by means of the control command at the output side. The control command output by the controller may also carry out ram control to the extent that the ram 7 which is standing free during the setting operation is relieved in terms of its hydraulic setting pressure by comparison with the right-hand ram 6. As a result of these control measures, individually or in combination, the above-mentioned one-sided loading of the powered shield support is cancelled, before the ram forces, in particular under the subsequent roof loading of the powered shield support, rise so sharply that overloading of the components of the powered shield support can occur.

FIG. 1 indicates another load situation in which the roof 22 has, in the supporting region of the powered shield support, such a cavity 23 that, when the powered shield support is being set and its rams 6 and 7 are being extended, the canopy 2 only comes into contact with the roof in its front end region, projecting towards the working face. Under the roof loading, tilting of the powered support may occur in such a manner that the rear part of its floor skid lifts off from the floor, so that the floor skid 1 finds a support on the floor only at its front skid end 1' at the working-face side. This critical load situation is also registered by the sensors and reported to the controller 13, whose monitoring and control electronics then carries out control measures preventing the load situation. This can be done, for example, in that the angle cylinder 11, under control of the controller 13, is loaded with hydraulic pressure in the retraction direction. Instead of or in addition to this, the hydraulic rams 6 and 7 can also be controlled, in terms of their hydraulic setting pressures, such that a stable position of the powered shield support during setting and in the set condition results.

In the case of the "tip-toeing" critical load situation specified above, the monitoring control can advantageously be carried out in such a way that when a permissible mechanical stressing (stress) is exceeded, which is preferably measured by stress sensors on the guide bar system and/or on the floor skid, the rams 6 and 7 are not set further and/or the angle cylinder or cylinders are retracted by being driven until a stress reduction lying within the permissible region is established at the controller. By contrast, the other critical load situation "one-sided load" can, as described above, be detected by the stresses in the gob shield hinge 8 being measured with the aid of the sensors 14. In the event of an elevated stress on one side in the gob shield hinge, the free ram responsible for this elevated stress (ram 7 in FIG. 2) is then not set further during the setting operation of the powered shield support, so that hazardous stress values cannot occur. On the other hand, however, the procedure may be such that in the event of exceeding a permissible angle, detected by the angle transmitter 15, the responsible ram, ram 7 in the example, is not set further, so that overloads threatening the components are also avoided with this measure. Finally, the control of the load in this load situation may also be performed such that in the event of a ram being extended too far on one side, namely the free ram 7, the latter is not set further or extended, by being driven appropriately. The abovementioned load controls can also be carried out in combination for the situation of one-sided load.

Using the device described, it is possible, with the aid of sensor technology and using the monitoring and control electronics of the controller 13, to carry out measures which reduce the loading and stress for different load situations such that overloading of the individual mechanical components of the powered shield support are reliably ruled out, the horizontal stiffness of the powered shield support not needing to be reduced, however. With the aid of the electro-hydraulic control system which is in any case present in the shield support, and by adding suitable sensors, which continuously monitor the shield support in relation to critical stress peaks and, with the aid of the control electronics, which control it in such a way that such damaging stresses are immediately detected and eliminated, the situation is provided wherein the powered shield supports do not have to be overdimensioned in terms of their stability and hence in terms of their weight, but can rather be constructed more lightly and more cost-effectively, which in turn opens up the possibility of increasing the overall width of the powered shield supports without exceeding the predefined weight limits, preferably to about 2 m. At the same time, because of the limiting of the maximum internal forces occurring in the shield support, its service life is increased by means of the invention. It goes without saying that the invention is not restricted to the load monitoring and load control of the powered shield support specified in the exemplary embodiment described, and that, in particular for the critical load situations "one-sided loading" and "tip-toeing", it is possible to operate with a different arrangement of the various sensors. What is primarily essential for the load situation of "one-sided loading" is that the load asymmetry associated with this is ascertained with the aid of the sensors, and the measured values are evaluated by the microelectronics of the controller in such a way that, by means of appropriately driving the hydraulic pressure spaces of the rams, mechanical overloading of the components of the powered shield support is reliably avoided.

We claim:

1. A hydraulic powered shield support for an underground mine having a floor and a roof, the support comprising:

a) a floor skid for resting on the floor of the mine;

b) at least one lemniscate linkage attached to said floor skid;

c) a canopy attached to said at least one lemniscate linkage for supporting the roof of the mine;

d) at least one pair of main hydraulic cylinders being left-side and right-side rams and arranged between said floor skid and said canopy; each main hydraulic cylinder having an extended length and an hydraulic setting pressure;

e) a pressure sensor assigned to each main hydraulic cylinder and measuring said hydraulic setting pressure therein and generating pressure signals in response thereto; and f) an electronic controller receiving said pressure signals from said pressure sensors, and in response thereto, if necessary, driving an appropriate main hydraulic cylinder accordingly to do one of eliminate and suppress potentially critical load situations from occurring and damaging said support.

2. The support as defined in claim 1, wherein said electronic controller receives and compares said pressure signals from said pressure sensors with each other, and in response thereto if a deviation between said pressure signals reaches a predetermined maximum limiting value, said electronic controller supplies control signals to drive said appropriate main hydraulic cylinder accordingly to do one of eliminate and suppress said potentially critical load situations from occurring and damaging said support.

3. The support as defined in claim 1, wherein said electronic controller drives said appropriate main hydraulic cylinder automatically.

4. The support as defined in claim 1, wherein said floor skid has a rear and said potentially critical load situations include at least one of one-sided loading of said canopy, one-sided loading of said floor skid, and lifting of said rear of said floor skid in a setting condition.

5. The support as defined in claim 1, wherein said support has a width in a range of over 1.75 meters to 2 meters.

6. The support as defined in claim 1, wherein said electronic controller drives said appropriate main hydraulic cylinder to do one of set, withdraw, and advance.

7. The support as defined in claim 1, wherein said electronic controller is equipped with microelectronics that continuously monitor and control load.

8. The support as defined in claim 7, wherein said microelectronics utilizes appropriate algorithms to continuously monitor and control load.

9. The support as defined in claim 1, wherein said lemniscate linkage comprises:

a) a gob shield attached to said canopy; and b) at least one pair of guide bars being left-side and right-side guide bars and arranged between said gob shield and said floor skid.

10. The support as defined in claim 9; further comprising a first mechanical stress measuring device arranged on said at least one pair of guide bars and determining mechanical stress in said at least one pair of guide bars and generating first stress signals in response thereto received by said electronic controller and in response thereto, if necessary, said electronic controller driving an appropriate main hydraulic cylinder accordingly to do one of eliminate and suppress the potentially critical load situations from occurring and damaging said support.

11. The support as defined in claim 10, wherein said electronic controller receives and compares said first stress signals from said first stress measuring devices with each other, and in response thereto if a deviation between said first stress signals occurs that reaches a predetermined maximum limiting value, said electronic controller supplies control signals to drive said appropriate main hydraulic cylinder accordingly to do one of eliminate and suppress said potentially critical load situations from occurring and damaging said support.

12. The support as defined in claim 11; further comprising a distance transducer assigned to each main hydraulic cylinder and determining said extension length of each said hydraulic cylinder and generating length signals in response thereto received by said electronic controller and in response thereto, if necessary, said electronic controller driving an appropriate main hydraulic cylinder accordingly to do one of eliminate and suppress the potentially critical load situations from occurring and damaging said support.

13. The support as defined in claim 12, wherein said electronic controller receives and compares said length signals from said length transducers with each other, and in response thereto if a deviation between said length signals reaches a predetermined maximum limiting value, said electronic controller supplies control signals to drive said appropriate main hydraulic cylinder accordingly to do one of eliminate and suppress said potentially critical load situations from occurring and damaging said support.

14. The support as defined in claim 13; further comprising at least one angle cylinder arranged between said canopy and said gob shield.

15. The support as defined in claim 14, wherein said gob shield is pivotally attached to said canopy by a gob shield hinge.

16. The support as defined in claim 15, wherein said gob shield hinge comprises at least one hinge bolt that passes through aligned hinge eyelets in said canopy and said gob shield.

17. The support as defined in claim 16; further comprising a second mechanical stress measuring device arranged on said gob shield hinge and determining mechanical stress in said gob shield hinge and generating a second stress signal in response thereto received by said electronic controller and in response thereto, if necessary, said electronic controller driving an appropriate main hydraulic cylinder accordingly to do one of eliminate and suppress the potentially critical load situations from occurring and damaging said support.

18. The support as defined in claim 17, wherein said electronic controller receives said second stress signal from said second mechanical stress measuring device, and in response thereto if said second stress signal reaches a predetermined maximum limiting value, said electronic controller supplies control signals to drive said appropriate main hydraulic cylinder accordingly to do one of eliminate and suppress said potentially critical load situations from occurring and damaging said support.

19. The support as defined in claim 17, wherein said second mechanical stress measuring device is arranged on said at least one hinge bolt of said gob shield hinge.

20. The support as defined in claim 17, wherein said second mechanical stress measuring device is arranged on any of said aligned hinge eyelets in said canopy and said gob shield.

21. The support as defined in claim 20, wherein said at least one pair of guide bars has a forwardmost pair of guide bars forming a right side and a left side; said forwardmost pair of guide bars and said gob shield forming angles therebetween.

22. The support as defined in claim 21; further comprising an angle transmitter located on said right side and said left side of said forwardmost pair of guide bars and determining said angles of said forwardmost pair of guide bars relative to said gob shield and generating angle signals in response thereto received by said electronic controller and in response thereto, if necessary, said electronic controller driving an appropriate main hydraulic cylinder accordingly to do one of eliminate and suppress the potentially critical load situations from occurring and damaging said support.

23. The support as defined in claim 22, wherein said electronic controller receives and compares said angle signals from said angle transmitters with each other, and in response thereto if a deviation between said angle signals occurs that reaches a predetermined maximum limiting value, said electronic controller supplies control signals to drive said appropriate main hydraulic cylinder accordingly to do one of eliminate and suppress said potentially critical load situations from occurring and damaging said support.

* * * * *